US007087861B2

(12) United States Patent
Rassatt et al.

(10) Patent No.: US 7,087,861 B2
(45) Date of Patent: Aug. 8, 2006

(54) MEDIA ENTRANCE GUIDE IN A THERMAL PROCESSOR

(75) Inventors: Bradley B. Rassatt, West Apple Valley, MN (US); James R. Hakala, Maplewood, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/029,302

(22) Filed: Jan. 5, 2005

(65) Prior Publication Data

US 2006/0151457 A1 Jul. 13, 2006

(51) Int. Cl.
*H05B 3/00* (2006.01)

(52) U.S. Cl. ..... 219/216; 219/469; 219/470; 219/243; 399/330; 399/331; 399/338

(58) Field of Classification Search ..... 219/216, 219/470, 469, 243; 399/330, 331, 338
See application file for complete search history.

(56) References Cited

U.S. PATENT DOCUMENTS

| | | | | |
|---|---|---|---|---|
| 3,534,673 | A | | 10/1970 | Mueller |
| 3,561,659 | A | | 2/1971 | Anthony |
| 4,093,273 | A | | 6/1978 | Fitzpatrick et al. |
| 4,946,756 | A | * | 8/1990 | Estavoyer et al. ..... 430/124 |
| 5,145,170 | A | | 9/1992 | Morita |
| 5,149,082 | A | | 9/1992 | Morita |
| 5,273,197 | A | | 12/1993 | Wenk |
| 5,615,961 | A | | 4/1997 | Wada |
| 5,617,986 | A | | 4/1997 | Kawamura |
| 5,869,806 | A | | 2/1999 | Struble et al. |
| 6,285,386 | B1 | | 9/2001 | Suzuki |
| 6,611,315 | B1 | | 8/2003 | Hashiguchi |

* cited by examiner

*Primary Examiner*—Shawntina Fuqua
(74) *Attorney, Agent, or Firm*—Susan L. Parulski

(57) ABSTRACT

A thermal processor including an oven for thermally developing an image in a media. The oven includes an entrance and a guide positioned at the entrance. The guide includes a receiver having a major surface configured to contact and receive the media and a separator configured to lift and separate the media from at least a portion of the major surface and to direct the media into the oven.

18 Claims, 5 Drawing Sheets

MEDIA ENTRANCE GUIDE IN A THERMAL PROCESSOR

FIELD OF THE INVENTION

The present invention relates generally to an apparatus and method for thermally processing an imaging media, and more specifically to an apparatus and method for thermally developing an imaging media employing an entrance guide to collect airborne contaminants produced by the development process.

BACKGROUND OF THE INVENTION

Photothermographic film generally includes a base material, such as a thin polymer or paper, typically coated on one side with an emulsion of heat sensitive materials. Once the film has been subjected to photostimulation, for example, by light from a laser of a laser imaging system, the resulting latent image is developed through application of heat to the film to form a visible image.

Several types of processing machines have been developed for developing photothermographic film. One type employs a rotating heated drum having multiple pressure rollers positioned around the drum's circumference to hold the film in contact with the drum during development. Another type slides the photothermographic film over flat, heated surfaces or plates. Still another type of processor, commonly referred to as a flat-bed processor, includes multiple rollers spaced to form a generally horizontal transport path that moves the photothermographic film through an oven.

Each of these processors heats the photothermographic film to at least a desired processing temperature for a set time, commonly referred to as the dwell time, for optimal film development. As the photothermographic film is heated, some types of emulsions produce gasses containing contaminants, such as fatty acids, which may subsequently condense when coming in contact with cooler air or surfaces within the processor. This is particularly true at the location where the photothermographic film enters a processor where external ambient air may be drawn into the processor. When contacting cooler air or surfaces, the gasses may condense and contaminants, fatty acids in particular, may become deposited on the photothermographic film and subsequently be transported to other processor components. These deposits can accumulate over time and can damage processor components, cause film jams within the processor, and cause visual defects in the developed image. As such, regular maintenance may be required to address problems resulting from such contaminants, which can be costly and result in processor downtime.

It is evident that there is a need for improving thermal processors to reduce problems associated with contaminants produced during development of photothermographic film.

SUMMARY OF THE INVENTION

In one embodiment, the present invention provides a thermal processor including an oven for thermally developing an image in a media, the oven having an entrance, and a guide positioned at the oven entrance. The guide includes a receiver having a major surface configured to contact and receive the media, and a separator configured to lift and separate the media from at least a portion of the major surface and to direct the media into the oven.

In one embodiment, the present invention provides a thermal processor. The thermal processor includes an oven for thermally developing an image in a media, wherein the media emits gaseous contaminants as the media moves through the oven from an entrance to an exit during development, the gaseous contaminants having a condensation temperature. A guide is positioned at the oven entrance and configured to direct the media into the oven. The guide includes a major surface configured to receive the media and a plurality of lift elements configured to separate the media from at least a portion of the major surface so as to form at least one collection area on the major surface not in contact with the media, the at least one collection area configured to have a temperature not exceeding the condensation temperature such that the gaseous contaminants condense and collect on the at least one collection area.

By forming at least one collection area not in contact with the media in which the gaseous contaminants collect and deposit, the likelihood that contaminants will deposit on the imaging media and other processor surfaces is reduced. As a result, the likelihood of image artifacts caused by condensed contaminants is reduced and maintenance requirements are also reduced.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
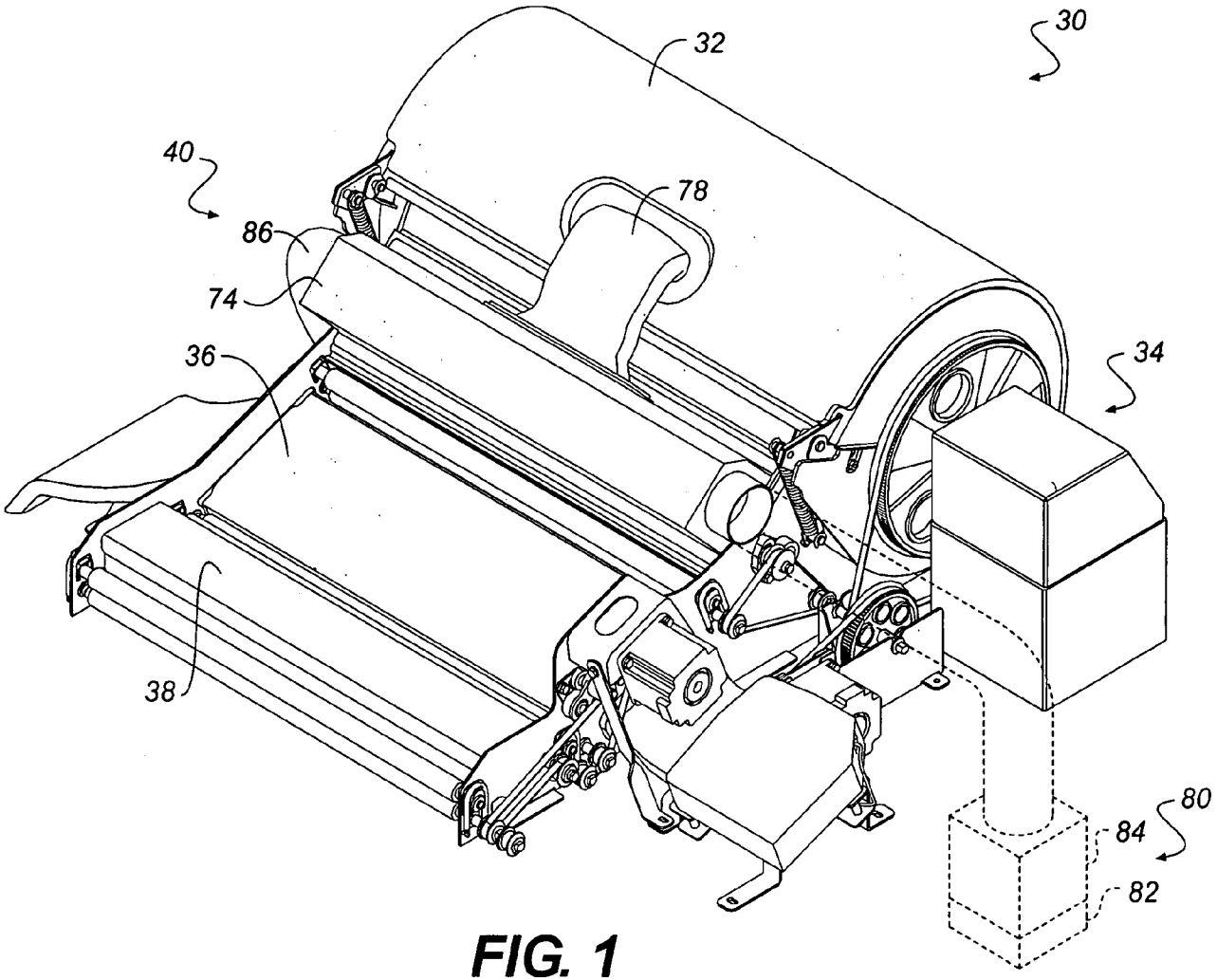
FIG. 1 is a perspective view illustrating generally a thermal processor employing an entrance guide in accordance with the present invention.

FIG. 1 is a perspective view illustrating generally a thermal processor 30 employing an entrance guide in accordance with the present invention configured to collect contaminants produced during development of a photothermographic media or film. As illustrated, thermal processor 30 includes a heated drum assembly 32, a drive system 34, a film cooling section 36, a densitometer 38, and an airborne contaminant removal system 40. In operation, exposed photothermographic media is thermally developed by heated drum assembly 32. The heated media is cooled while passing over cooling section 36. Densitometer 38 reads density control patches on the developed media before the developed media is output to a user. Contaminant removal system 40 is configured to remove airborne contaminants from heated drum assembly 32 produced during the thermal development process.

Figure 2:
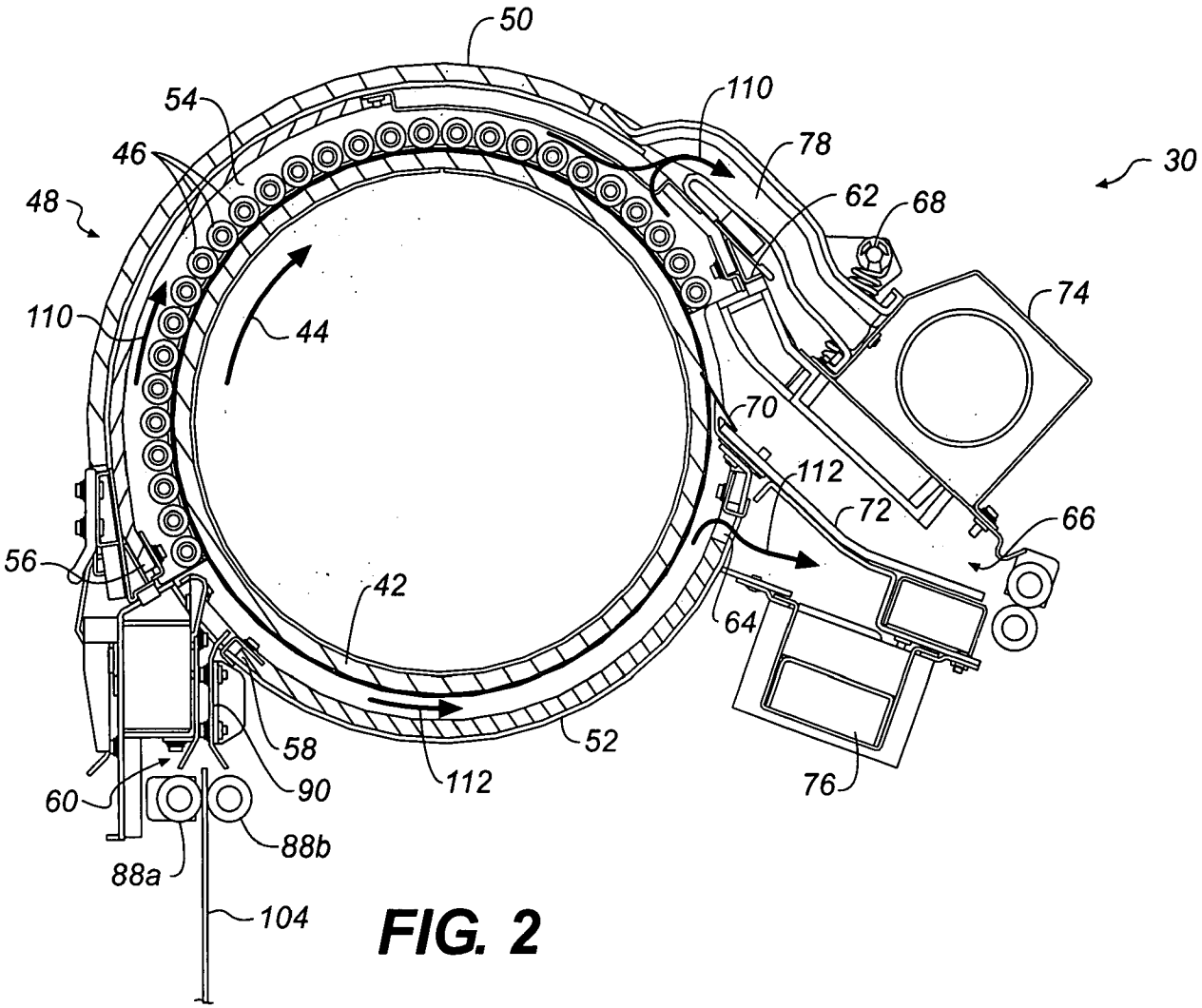
FIG. 2 is a cross-sectional view illustrating in greater detail portions of the thermal processor of FIG. 1.

FIG. 2 is a cross-sectional view illustrating in greater detail portions of thermal processor 30 of FIG. 1. Heated drum assembly 32, includes a heated drum 42 which rotates in a direction 44 as driven by drive assembly 34. Heated drum assembly 32 further includes a plurality of pressure rollers 46 circumferentially arrayed about a segment of drum 42 and configured to hold an exposed media in contact with drum 42 during development. An enclosure 48, including an upper curved cover 50 spaced from pressure rollers 46 and a lower curved cover 52 spaced from a lower portion of drum 42, enclose and form an oven 54 around drum 42 and pressure rollers 46.

Upper and lower covers 50 and 52 have respective first ends 56 and 58 spaced from one another to define a media (film) entrance region 60, and respective second ends 62 and 64 forming a media (film) exit region 66. Upper cover 50 can be rotated around a hinge 68 so that enclosure 48 can be opened to allow access to drum 42 and pressure rollers 46. A film diverter 70 diverts film from contact with drum 42 to exit region 66 over a perforated felt pad 72.

An upper condensation trap 74, lower condensation trap 76, and flexible duct 78 form a portion of contaminant removal system 40. As illustrated by the dashed lines in FIG. 1, contaminant removal system 40 further includes a vacuum system 80 coupled to upper condensation trap 74, vacuum system 80 including a fan 82 and a filter 84. A duct 86, also as illustrated in FIG. 1, connects lower condensation trap 76 to upper condensation trap 74. A contaminant removal system similar to that described above is described by U.S. Pat. No. 6,812,947 entitled "Contaminant Removal System in a Thermal Processor", which is assigned to the same assignee as the present application and is herein incorporated by reference.

Figure 3:
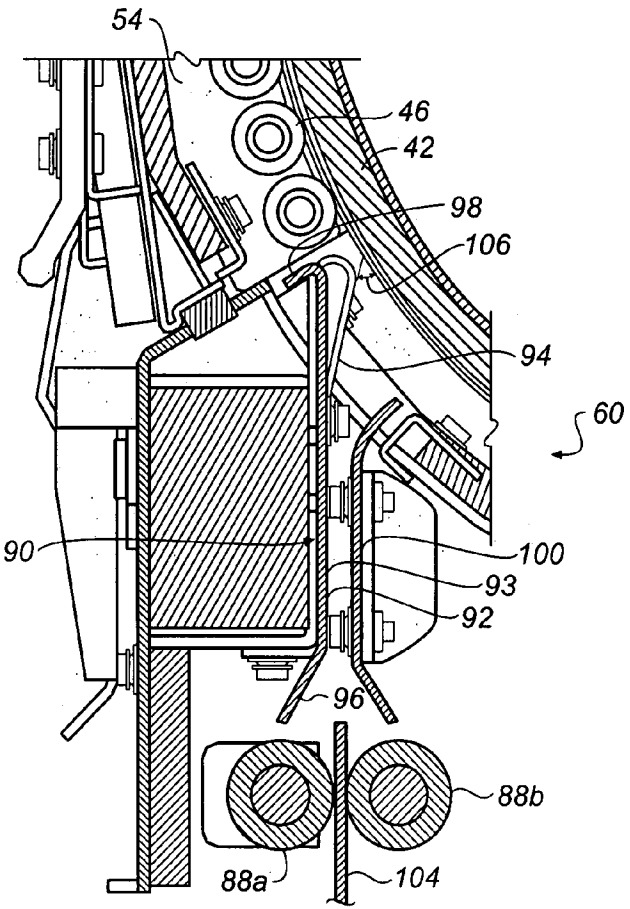
FIG. 3 is an enlarged cross-sectional view illustrating in greater detail a portion of the thermal processor illustrated by FIG. 2.

Entrance region 60 includes a pair of feed rollers, 88*a* and 88*b*, and an entrance guide 90 according to one embodiment of the present invention. FIG. 3 is an enlarged cross-sectional view illustrating in greater detail entrance region 60 and entrance guide 90. Entrance guide 90 includes a receiver, or guide plate 92, having a major surface 93 and a separator, or media ramp 94. Guide plate 92 has a leading edge 96 positioned proximate to feed rollers 88 and a trailing edge 98 positioned within oven 54. Media ramp 94 extends angularly from major surface 93 of guide plate 92 generally along trailing edge 98 and is positioned substantially within oven 54. Entrance region 60 further includes a second guide plate 100 positioned in parallel with surface 93 of guide plate 92.

Figure 4:
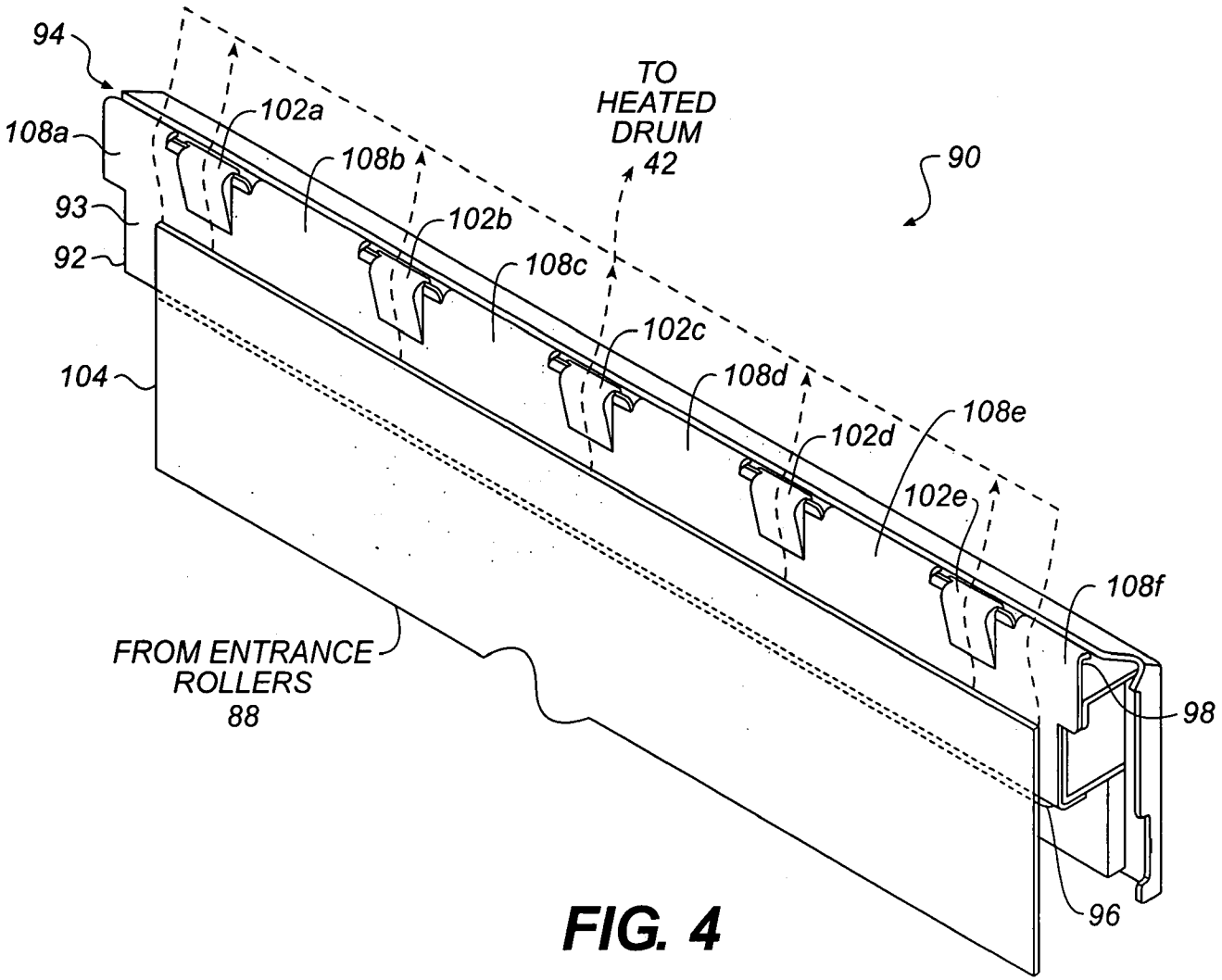
FIG. 4 is a perspective view illustrating one embodiment of an entrance guide according to the present invention.

FIG. 4 is a perspective view illustrating one embodiment of entrance guide 90 according to the present invention. As illustrated, media ramp 94 comprises a plurality of ramp-like lift elements 102, illustrated as lift elements 102*a* to 102*e*. Lift elements 102 are spaced along trailing edge 98, with each extending angularly from major surface 93 of guide plate 92. In one embodiment, as illustrated, lift elements 102 are inserted within a series of space cut-outs along trailing edge 98 of guide plate 92.

During operation, drum 42 is heated to a temperature necessary to provide a uniform development temperature to the imaging media being developed. For photothermographic medical film, for example, drum 42 operates at a temperature of approximately 122.5° C. In one embodiment, drum 42 is heated by a circumferentially uniform resistive heater mounted within drum 42. Drum 42 heats pressure rollers 46, oven 54, and other processor components including guide plate 92 and lift elements 102 of entrance guide 90.

Feed rollers 88*a* and 88*b* receive a piece of imaging media, such as imaging media 104, at an ambient temperature and form a nip to feed imaging material to drum 42. Entrance guide 90 receives imaging media 104 along leading edge 96, and together with guide plate 100, channels imaging media 104 toward drum 42. In one embodiment, media ramp 94 (e.g., lift elements 102) is positioned so that imaging media 104 contacts drum 42 at a desired angle (θ) 106 (see FIG. 3). Upon contacting drum 42, imaging media 104 wraps around a segment of the circumference of drum 42 and is held against drum 42 by pressure rollers 46.

Photothermographic film, such as imaging material 104, generally comprises a base material, such as a thin polymer or paper, which is typically coated on side with an emulsion of heat sensitive materials. As imaging media 104 enters oven 54 and begins to wrap around drum 42, imaging media 104 begins to be heated to the desired development temperature. As the emulsion is heated, it produces gasses containing contaminants, fatty acids (FAZ) in particular, that may subsequently condense on processor surfaces having temperatures at or below a corresponding condensation temperature of the gasses.

In efforts to remove these airborne contaminants, vacuum system 80 draws air into oven 54 from entrance region 60 and produces upper and lower air streams 110 and 112 around drum 42, as illustrated in FIG. 2. Upper air stream 110 is drawn into upper condensation trap 74 via duct 78 and lower air stream 112 is drawn in lower condensation trap 76, wherein the gasses are mixed with ambient air and subsequently condense. While contaminant removal system 40 is effective, it may not remove all gasses from within enclosure 48, particularly in entrance region 60 where the greatest heat transfer to imaging media 104 occurs and consequently, where the emulsion produces a large amount of gas. Furthermore, since ambient air and imaging material 104 both enter oven 54 in entrance region 60, FAZ and other contaminants are more likely to condense in entrance region 60 than other areas of thermal processor 30. The condensed FAZ may also deposit on imaging media 104, resulting in artifacts in the developed image. Imaging media 104 may also transport the condensed FAZ to other portions of thermal processor 30 and potentially damage other components of thermal processor 30.

As described above, entrance guide 90, including guide plate 92 and lift elements 102, are heated by drum 42. Also as described above, entrance guide 90 receives imaging media 104 at leading edge 96 and directs imaging media 104 to heated drum 42. As imaging media 104 moves across major surface 93 of guide plate 92, imaging media 104 absorbs heat from guide plate 92, causing guide plate 92 to become cooler than interior components of thermal processor 30, such as drum 42 and pressure rollers 46. In one embodiment, guide plate 92 comprises a material having a high thermal conductivity such that as imaging material 104 absorbs heat from guide plate 92, the temperature of guide plate 92 is reduced to a level not exceeding the condensation temperature of gases produced by the emulsion of imaging media 104. In one embodiment, guide plate 92 comprises a metal, such as stainless steel.

As imaging media 104 contacts and slides across lift elements 102, lift elements 102 separate and lift imaging media 104 away from major surface 93 of guide plate 92, forming a plurality of collection areas 108 adjacent to lift elements 102 on major surface 93 of guide plate 92 that are not in contact with imaging media 104. In one embodiment, lift elements 102 comprise a material having a low thermal conductivity, such that lift elements 102 transfer minimal amounts of thermal energy to imaging material 104 and maintain a temperature above the condensation temperature of gasses produced by the emulsion of imaging media 104. In one embodiment, lift elements 102 comprise a polycarbonate material.

Since guide plate 92 is maintained at a temperature less than the condensation temperature, collection areas 108 are also at or below the condensation temperature. Therefore, the gases produced by imaging media 104 as it enters oven 54 and begins to wrap around and be heated by heated drum 42 condense and deposit on collection areas 108. Additionally, since lift elements 102 are maintained above the condensation temperature, the gaseous contaminants produced by imaging media 104 do not condense on lift elements 102. As such, the gasses and associated contaminants produced in the vicinity of entrance region 60, FAZ in particular, condense and deposit in collection areas 108 on the surface of guide plate 92 and do not deposit on imaging media 104 or other surfaces.

By forming collection areas 108 that are not in contact with the imaging media and by maintaining these areas at temperatures not exceeding the condensation temperature; entrance guide 90 according to the present invention controls the locations where FAZ and other gaseous contaminants will condense and deposit. As such, entrance guide 90 reduces the likelihood that such contaminants will be deposited on the imaging media and, as a result, reduces the occurrence of image artifacts caused by contaminants deposited on the film. It also reduces the likelihood that such contaminants will be deposited on other processor surfaces, thereby reducing maintenance requirements and further reducing potential sources of image artifacts.

Figure 5:
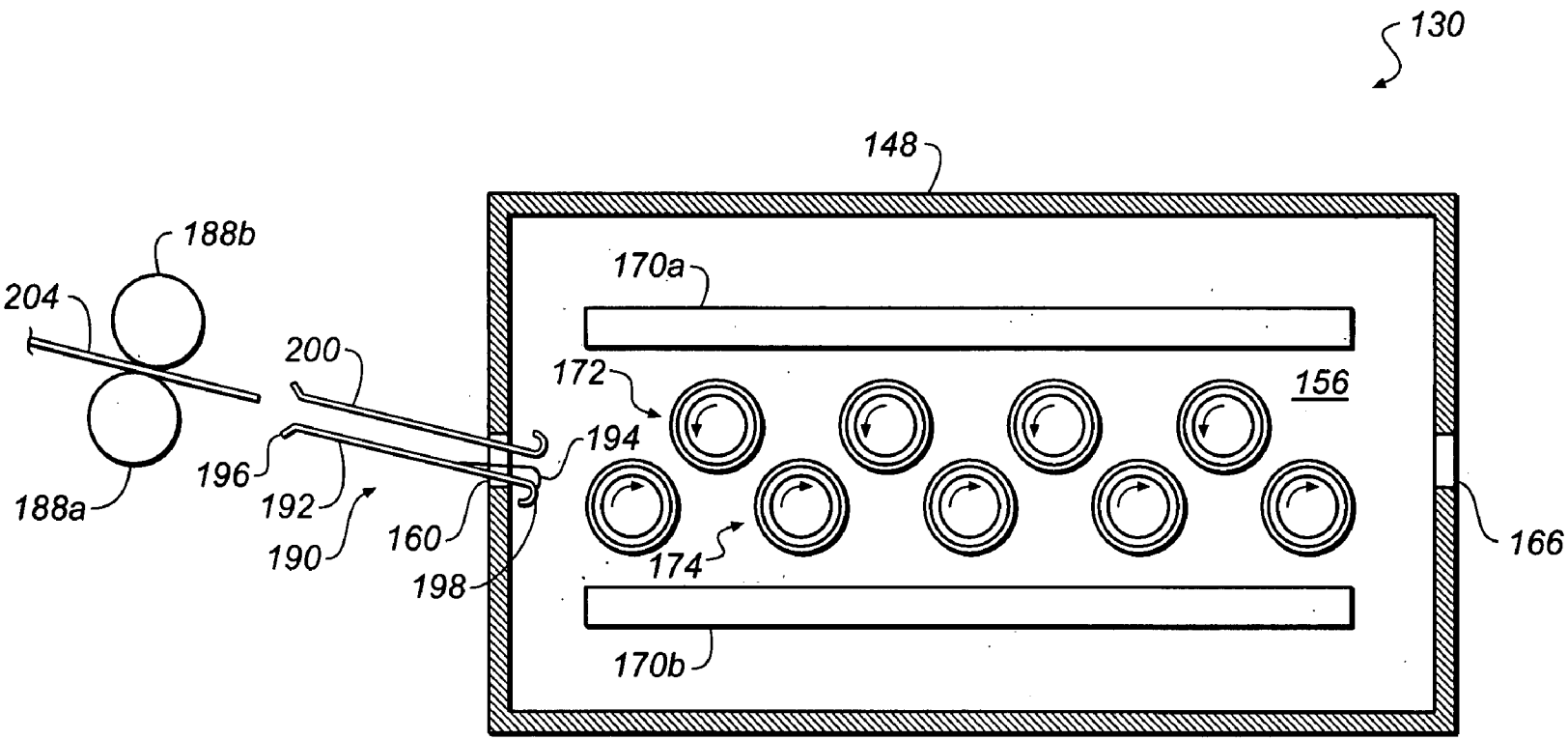
FIG. 5 is a cross-sectional view illustrating generally another thermal processor employing an entrance guide in accordance with the present invention.

FIG. 5 is a cross-sectional view illustrating generally another exemplary embodiment of a thermal processor 130 employing an entrance guide 190 in accordance with the present invention. Thermal processor 130 is commonly referred to as a flat-bed type thermal processor and includes an enclosure 148 forming an oven 156 having an entrance region 160 and an exit region 166. Upper and lower heat sources 170*a* and 170*b* are configured to maintain oven 156 substantially at a desired development temperature. A plurality of upper rollers 172 and a plurality of lower rollers 174 are positioned in a spaced relationship and configured to transport imaging media 204 through oven 156 during the development process.

A pair of feed rollers 188*a* and 188*b* receive a piece of imaging material, such as imaging material 204, and form a nip to feed imaging material 204 to oven 156. Entrance guide 190 includes a guide plate 192 and a media ramp 194. Guide plate 192 has a leading edge 196 and a trailing edge 198 positioned within oven 156. Ramp 194 extends angularly from guide plate 192 along trailing edge 198 and is positioned substantially within oven 156. A guide plate 200 is positioned in a parallel with guide plate 192 and together with entrance guide 190 channel imaging media 204 into oven 156. In one embodiment, media ramp 194 is positioned such that imaging media 204 enters oven 156 at a desired angle relative to rollers 172 and 174.

In a fashion similar to that described above with respect to the drum-type processor illustrated by FIGS. 1–3, as imaging media 204 moves across guide plate 192, imaging media 204 absorbs heat from guide plate 192, causing guide plate 192 to remain at a temperature at or below the condensation temperature. As imaging media 204 slides across media ramp 194, media ramp 194 lifts and separates imaging media 204 from guide plate 192, thereby forming at least one collection area along the leading edge 198 of guide plate 192 that is not in contact with imaging media 204. Since this collection area is at a temperature not exceeding the condensation temperature, gasses at entrance region 160 produced during thermal development of imaging media 204 condense and deposit on the at least one collection area instead of on imaging media 204 or other surfaces of processor 130. In one embodiment, media ramp 194 comprises a plurality of lift elements that form a plurality of collection areas, similar to lift elements 102 and collection areas 108 as illustrated by FIG. 4.

All documents, patents, journal articles and other materials cited in the present application are hereby incorporated by reference.

The invention has been described in detail with particular reference to certain preferred embodiments thereof, but it will be understood that variations and modifications can be effected within the spirit and scope of the invention.

PARTS LIST

| | |
|---|---|
| 30 | Thermal Processor |
| 32 | Heated Drum Assembly |
| 34 | Drive System |
| 36 | Film Cooling Section |
| 38 | Densitometer |
| 40 | Contaminant Removal System |
| 42 | Heated Drum |
| 44 | Directional Arrow |
| 46 | Pressure Rollers |
| 48 | Enclosure |
| 50 | Upper Cover |
| 52 | Lower Cover |
| 54 | Oven |
| 56, 58 | First Ends |
| 60 | Entrance Region |
| 62, 64 | Second Ends |
| 66 | Exit Region |
| 68 | Hinge |
| 70 | Film Diverter |
| 72 | Felt Pad |
| 74 | Upper Condensation Trap |
| 76 | Lower Condensation Trap |
| 78 | Flexible Duct |
| 80 | Vacuum System |
| 82 | Fan |
| 84 | Filter |
| 86 | Duct |
| 88 | Feed Rollers |
| 90 | Entrance Guide |
| 92 | Guide Plate |
| 93 | Major Surface |
| 94 | Media Ramp |
| 96 | Guide Plate - Leading Edge |
| 98 | Guide Plate - Trailing Edge |
| 100 | Guide Plate |
| 102 | Lift Elements |
| 104 | Imaging Media |
| 106 | Contact Angle |
| 108 | Collection Areas |
| 110, 112 | Air Flow Direction |
| 130 | Thermal Processor |
| 148 | Enclosure |
| 156 | Oven |
| 160 | Entrance Region |
| 166 | Exit Region |
| 170a, 170b | Upper and Lower Heat Sources |
| 172, 174 | Upper and Lower Rollers |
| 188a, 188b | Feed Rollers |
| 190 | Entrance Guide |
| 192 | Guide Plate |
| 194 | Media Ramp |
| 196 | Guide Plate - Leading Edge |
| 198 | Guide Plate - Trailing Edge |
| 200 | Guide Plate |
| 204 | Imaging Media |

What is claimed is:

1. A thermal processor comprising:

an oven for thermally developing an image in a media, the oven including an entrance; and a guide positioned at the oven entrance, the guide comprising: (a) a receiver having a major surface configured to contact and receive the media, and (b) a separator configured to lift and separate the media from at least a portion of the major surface to direct the media into the oven, wherein the separator is configured to have a temperature above a threshold temperature and the portion of the major surface from which the media is separated is configured to have a temperature not exceeding the threshold temperature.

2. The thermal processor of claim 1, wherein the threshold temperature is defined by a condensation temperature of gaseous contaminants released by the media during thermal development.

3. The thermal processor of claim 1, wherein media absorbs thermal energy from the receiver to maintain the portion of the major surface not in contact with the media at the temperature not exceeding the threshold temperature.

4. A thermal processor comprising:

an oven for thermally developing an image in a media the oven including an entrance; and a guide positioned at the oven entrance, the guide comprising: (a) a receiver having a major surface configured to contact and receive the media, and (b) a separator configured to lift and separate the media from at least a portion of the major surface to direct the media into the oven, wherein the separator comprises a material having low thermal conductivity characteristics.

5. The thermal processor of claim 4, wherein the separator comprises a plurality of lift elements configured to form a plurality of collection areas which are separated from the media.

6. The thermal processor of claim 5, wherein the lift elements angularly extend from the major surface of the receiver.

7. The thermal processor of claim 4, wherein the separator is positioned at least partially with the oven.

8. A thermal processor comprising:

an enclosure including an entrance region;

a heated drum for thermally developing an image in a media positioned within the enclosure; and a media guide positioned at the entrance region and configured to direct media to the heated drum, the media guide comprising:

a guide plate having a major surface and configured to contact and receive the media along a leading edge positioned external to the enclosure and having a trailing edge positioned at least partially within the enclosure; and a plurality of lift elements spaced along the trailing edge and configured to separate the media from the guide plate to form a plurality of collection areas along the trailing edge that are not in contact with the media.

9. The thermal processor of claim 8, wherein the guide plate is configured to have a temperature not exceeding a threshold temperature and the lift elements are configured to have a temperature above the threshold temperature.

10. The thermal processor of claim 9, wherein the guide plate transfers heat to media at an ambient temperature contacting the guide plate to maintain the guide plate at a temperature below the threshold temperature.

11. The thermal processor of claim 8, wherein the lift elements extend angularly from the major surface so that the media contacts the heated drum substantially at a desired angle.

12. The thermal processor of claim 8, wherein the lift elements comprise a material having low thermal conductivity characteristics.

13. A thermal processor comprising:

an oven for thermally developing an image in a media, wherein the media emits gaseous contaminants as the media moves through the oven from an entrance to an exit during development, the gaseous contaminants having a condensation temperature; and a guide positioned at the oven entrance and configured to direct the media into the oven, the guide comprising:

a major surface configured to receive the media; and a plurality of lift elements configured to separate the media from at least a portion of the major surface and to form at least one collection zone on the major surface not in contact with the media, the at least one collection zone configured to have a temperature not exceeding the condensation temperature such that the gaseous contaminants condense and collect on the at least one collection zone.

14. A method of operating a thermal processor to remove gaseous contaminants produced during thermal development of an imaging media, the method comprising:

receiving the imaging media via a major surface of an entrance guide;

separating the imaging media from at least a portion of the major surface;

maintaining the entrance guide at a temperature not exceeding a condensation temperature of the gaseous contaminants; and condensing the gaseous contaminants on the portion of the major surface which is separated from the imaging media.

15. The method of claim 14, wherein maintaining the entrance guide at a temperature not exceeding the condensation temperature comprises transferring thermal energy from the entrance guide to the imaging media.

16. The method of claim 14, wherein separating the imaging media from the major surface further comprises separating the imaging media from the major surface such that the imaging media forms a substantially desired angle with the major surface.

17. A thermal processor comprising:

an oven for thermally developing an image in a media wherein the media produces gaseous contaminants during thermal development;

an entrance guide including a major surface configured to receive and direct the media into the oven;

means for separating the media from at least a portion of the major surface; and means for maintaining the portion of the major surface separated from the media at a temperature not exceeding a condensation temperature of the gaseous contaminants.

18. The thermal processor of claim 17 further comprising:

means for maintaining the means for separating at a temperature above a condensation temperature of the gaseous contaminants.

* * * * *